US012746448B2

(12) United States Patent
Miller

(10) Patent No.: US 12,746,448 B2
(45) Date of Patent: Sep. 29, 2026

(54) MODULAR PUTTING GREEN

(71) Applicant: The Innovation Machine, Pinedale, WY (US)

(72) Inventor: Scott Earl Miller, Pinedale, WY (US)

(73) Assignee: The Innovation Machine, Pinedale, WY (US)

( * ) Notice: Subject to any disclaimer, the term of this patent is extended or adjusted under 35 U.S.C. 154(b) by 384 days.

(21) Appl. No.: 18/492,519

(22) Filed: Oct. 23, 2023

(65) Prior Publication Data

US 2024/0131411 A1 Apr. 25, 2024
US 2024/0226693 A9 Jul. 11, 2024

Related U.S. Application Data

(60) Provisional application No. 63/380,517, filed on Oct. 21, 2022.

(51) Int. Cl.
*A63B 69/36* (2006.01)

(52) U.S. Cl.
CPC ..... *A63B 69/3661* (2013.01)

(58) Field of Classification Search
CPC ..... A63B 69/3676; A63B 69/3661; A63B 69/3691; A63B 69/3697
See application file for complete search history.

(56) References Cited

U.S. PATENT DOCUMENTS

| | | | | |
|---|---|---|---|---|
| 2,061,973 | A * | 11/1936 | Loeb | A63B 69/3676 473/192 |
| 4,311,312 | A * | 1/1982 | O'Brien | A63B 69/3661 473/270 |
| 4,913,442 | A * | 4/1990 | Walker | A63B 69/3661 428/17 |
| 8,616,988 | B1 | 12/2013 | Coffman | |
| 9,016,972 | B2 | 4/2015 | Oetlinger | |
| 9,028,335 | B1 | 5/2015 | Coffman | |
| 9,308,429 | B1 | 4/2016 | Coffman | |
| 9,987,542 | B2 | 6/2018 | Coffman | |
| 9,987,543 | B2 | 6/2018 | Coffman | |
| 9,993,713 | B2 | 6/2018 | Coffman | |
| 10,137,351 | B2 | 11/2018 | Coffman | |
| 10,486,047 | B2 | 11/2019 | Coffman | |
| 2021/0354019 | A1* | 11/2021 | Karr | B32B 5/245 |

FOREIGN PATENT DOCUMENTS

TW 201621493 A * 6/2016

OTHER PUBLICATIONS

Machine translation of TW201621493 (Year: 2016).*

* cited by examiner

*Primary Examiner* — Brian O Peters
(74) *Attorney, Agent, or Firm* — Ziolkowski Patent Solutions Group, SC

(57) ABSTRACT

A modular putting green includes a foam pad sculpted for putting a golf ball. A putting green insert is configured to fit within a recessed area of the foam pad. The foam pad may be positioned on a stage having a frame and a platform or on another surface. The foam pad and putting green insert are interchangeable with other foam pads and putting green inserts to change the configuration of the modular putting green for a user.

20 Claims, 12 Drawing Sheets

MODULAR PUTTING GREEN

CROSS-REFERENCE TO RELATED APPLICATIONS

The present application is a non-provisional of and claims priority to U.S. Provisional Patent Application Ser. No. 63/380,517, filed Oct. 21, 2022, the disclosure of which is incorporated herein by reference in its entirety.

BACKGROUND OF THE INVENTION

Embodiments of the present invention relate to putting greens and, more particularly, to modular putting greens and methods of making and assembling such modular putting greens.

In the past, golfers have had to go to outdoor golf courses in order to practice or compete in events or tournaments, s. County parks systems, country clubs, and other organizations that create these golf courses have typically constructed them using live or organic materials such as, for example, grass and sod. Due to the use of live or organic materials, these golf courses come with high maintenance costs for watering, mowing, landscaping, and the like. One exception is mini-golf courses, which generally utilize artificial turf to form different putting greens.

However, with improvements to artificial grass or turf, golfers have been able to buy their own putting greens for use at home. Further, outdoor golf courses may utilize such putting greens either in practice areas or on the courses themselves. However, the construction and installation of these putting greens are complicated, time consuming, and costly. For example, when installing a putting green based on a model showing specific slopes at various positions, the installers use dirt to form the initial pattern for the green. The installers have to place dirt, tamp it down, and test the surface to make sure the slope is correct. They may test the surface by rolling a ball across the surface in order to see if the ball travels in the intended direction. This testing usually requires many iterations of reshaping the dirt before the turf may be placed on top.

While a consumer may be able to select a design for the putting green for installation with this process, the installers will not likely produce the exact design due to having to manual placement and shaping of the dirt. Further, the consumer will not be able to change the design of the green without tearing up the turf and reshaping the dirt over again. In fact, the consumer may have to install a completely new putting green in order to achieve a different design. Additionally, the dirt may shift over time and require reshaping, even if the consumer would like to keep the original design. As such, not only does this type of putting green require a difficult, costly, and time-consuming installation that cannot be completed with exact precision, the consumer is limited to the configuration of the installed putting green unless the consumer is willing to pay additional costs for a new putting green or a reshaping of the original putting green. Furthermore, severe weather may significantly alter the shape of the dirt, and such alterations may be expensive to fix.

It would therefore be desirable to provide a modular putting green that can be designed by the consumer, constructed with precision, easily installed, protected from the elements, and modified or moved after installation via replaceable and/or adjustable components.

BRIEF STATEMENT OF THE INVENTION

In accordance with one aspect of the invention, a modular putting green includes an adjustable stage having a platform and a frame comprising a plurality of frame rails and legs configured to couple to and support the platform. In addition, the modular putting green includes a foam pad configured to mate with the stage, sculpted for putting of a golf ball, and comprising a recessed area. The modular putting green also includes a putting green insert configured to fit at least partially within the recessed area of the foam pad.

In accordance with another aspect of the invention, a modular putting green includes a foam pad with a top surface sculpted to be positioned at a predetermined orientation for putting a golf ball and having a recessed area. The foam pad additionally includes a bottom surface having a stage surface geometry configured to mate with an adjustable stage such that the top surface is positioned at the predetermined orientation, a direct surface geometry configured to be positioned on and account for imperfections in a surface of a preselected putting area such that the top surface is positioned at the predetermined orientation, or a combination surface geometry configured to either mate with the adjustable stage or to be positioned on and account for imperfections in the surface of the preselected putting area such that the top surface is positioned at the predetermined orientation. Furthermore, the modular putting green includes a putting green insert configured to fit at least partially within the recessed area of the foam pad.

In accordance with yet another aspect of the invention, a method of manufacturing a modular putting green includes sculpting a foam pad. The foam pad includes a top surface is sculpted to be positioned at a predetermined orientation for putting a golf ball and has a recessed area. The foam pad also includes a bottom surface having a stage surface geometry configured to mate with an adjustable stage such that the top surface is positioned at the predetermined orientation, a direct surface geometry configured to be positioned on and account for imperfections in a surface of a preselected putting area such that the top surface is positioned at the predetermined orientation, or a combination surface geometry configured to either mate with the adjustable stage or to be positioned on and account for imperfections in the surface of the preselected putting area such that the top surface is positioned at the predetermined orientation. The method further includes providing a putting green insert configured to fit at least partially within the recessed area of the foam pad.

These and various other features and advantages of the present invention will be more readily understood from the following detailed description and the accompanying drawings.

BRIEF DESCRIPTION OF THE DRAWINGS

The drawings illustrate embodiments presently contemplated for carrying out the invention.

In the drawings.

DETAILED DESCRIPTION

Embodiments of the present invention provide for a modular putting green and a method for assembling the same. The modular putting green includes a foam pad sculpted for putting a golf ball. The foam pad includes a recessed area for a putting green insert on which a golfer may putt. A bottom surface of the foam pad may be configured for placement of the foam pad directly on a surface of a preselected putting area such the geometry of the bottom surface accounts for imperfections in the surface of the preselected putting area. The foam pad may also be positioned on an adjustable platform and/or stage.

Figure 1:
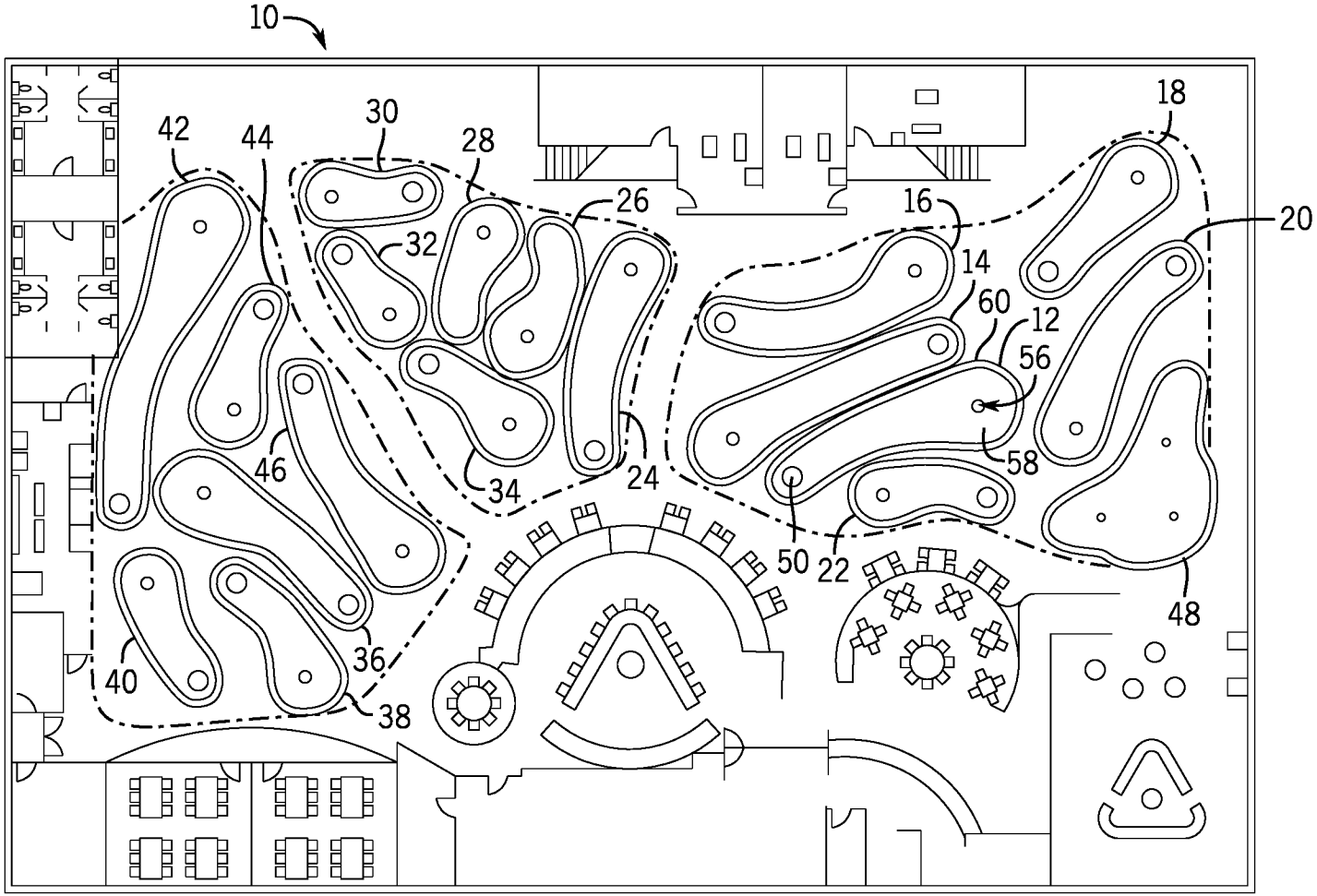
FIG. 1 is a diagram of an arrangement of modular putting greens, according to an embodiment of the invention.

Referring to FIG. 1, a diagram of an arrangement 10 of modular putting greens 12-48 for use by golfers is shown, according to an embodiment of the invention. While modular putting greens 12-48 are shown in an indoor setting and, therefore, protected from the environment, modular putting greens 12-48 may be used in an outdoor setting as well. Modular putting greens 12-48 have a variety of configurations with different shapes and contours. However, modular putting greens 12-48 are not limited to the configurations shown and may have any configuration desired by a golfer or golfing organization for the purpose of practicing golf or hosting a golfing competition.

Referring now to FIGS. 2-12, modular putting green 12 of FIG. 1 will be described, according to an embodiment of the invention. The description of modular putting green 12 is also applicable to modular putting greens 14-48, as each modular putting green 12-48 will have the same base components in various configurations as well the opportunity to include the optional features described with respect to modular putting green 12. That is, the particular configuration of modular putting green 12 is described herein as an example and should not be considered as limiting the available configurations of modular putting greens according to embodiments of the invention.

Figure 2:
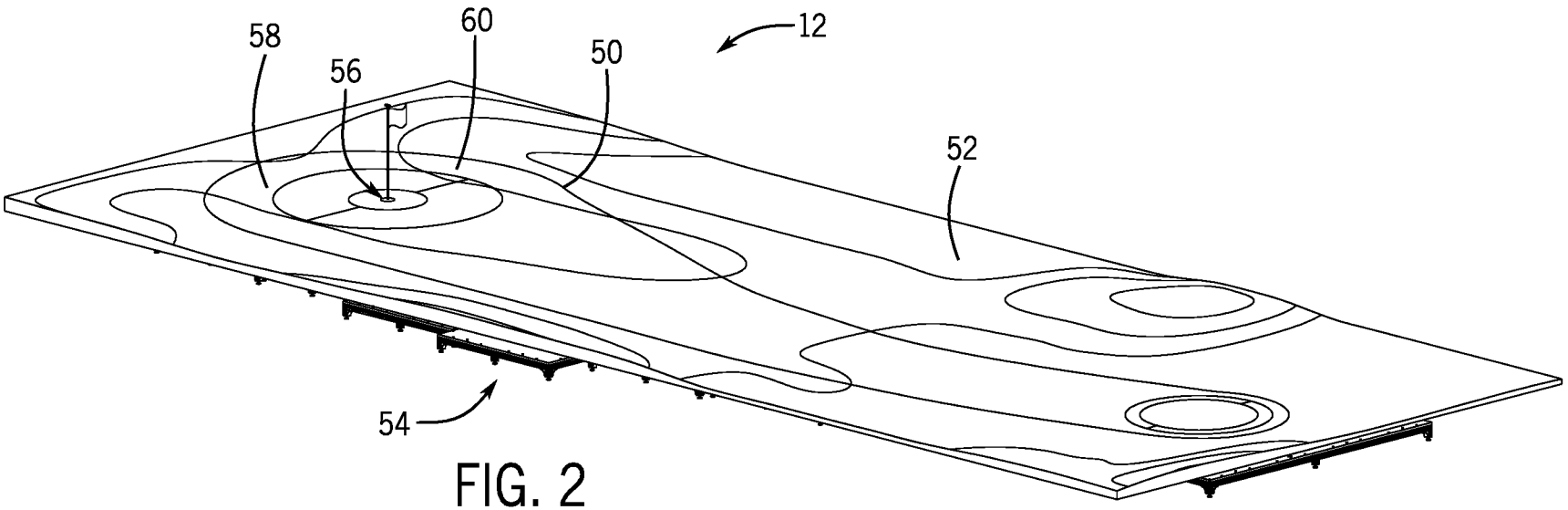
FIG. 2 is a top perspective view of a modular putting green shown in FIG. 1, according to an embodiment of the invention.

Referring now to FIG. 2, a top perspective view of modular putting green 12 is shown, according to an embodiment of the invention. Modular putting green 12 includes a putting green insert 50, a foam pad or mat 52, and a stage 54. Putting green insert 50 is generally formed of an artificial turf and includes at least one hole 56 therein to be used as an objective for performing a putt. The artificial turf may be made of a variety of different materials based on the characteristics desired by the user such as, for example, color, speed, and thickness. Putting green insert 50 is sized to fit tightly into foam pad 52 so that putting green insert 50 does not interfere with a golfer attempting a putt.

Putting green insert 50 may include different types of materials in different areas, as desired. As a non-limiting example, a central or green area 58 of putting green insert 50 may be formed of a material corresponding to a green on a typical golf course, and an outer or fringe area 60 of putting green insert 58 may be formed of a material corresponding to a fringe area around a green on a typical golf course. However, putting green insert 50 may be formed of a different number of materials such as, for example, one, three, or four materials, depending on the preference of the user.

Figure 3:
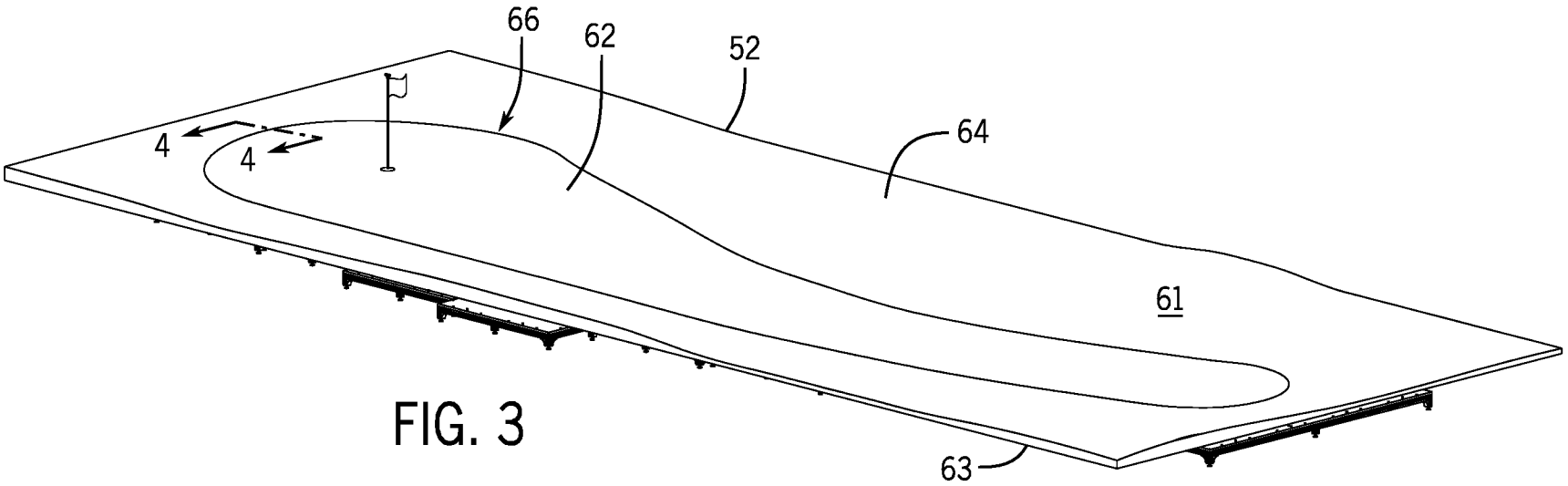
FIG. 3 is a top perspective view of the modular putting green of FIG. 2 with a putting green insert removed, according to an embodiment of the invention.

Referring now to FIG. 3, a top perspective view of modular putting green 12 without putting green insert 40 is shown, according to an embodiment of the invention. FIG. 3 provides a clearer view of foam pad 52, which includes an inner area 62 and an outer area 64. Inner area 62 includes a recessed area 66 sized to receive at least a portion of putting green insert 50. Recessed area 66 may also optionally receive a plurality of pressure sensors (not shown) for providing feedback on use of modular putting green 12. Referring back to FIG. 2, recessed area 66 is shown as receiving only green area 58 of putting green insert 50, with fringe area 60 of putting green insert 50 being positioned on top of outer area 64 of foam pad 52. However, in various embodiments, recessed area 66 of foam pad 52 may be sized receive a larger area than green area 58 of putting green insert 50 such as, for example, the entirety of putting green insert 50 or the entirety of green area 58 of putting green insert 50 and part of fringe area 60 of putting green insert 50.

Referring again to FIG. 3, foam pad 52 may be constructed with a variety of different configurations with various contours, shapes, and geometries to meet the goals of a consumer purchasing modular putting green 12. The consumer will be able to provide input on the design of foam pad 52 to achieve specific objectives such as, for example, a specific level of difficulty or a copy of an already existing putting green from a specific golf course. Once a design for foam pad 52 is ready, foam pad 52 is sculpted from one or more blocks of foam. The foam material used to create foam pad 52 may vary based on the characteristics desired by the consumer. Generally, the foam material should machine well, be durable, and have some sponginess. One non-limiting example of foam material for use as foam pad 52 is expanded polypropylene. The foam material may be sculpted or machined by a computer numerical control (CNC) machine that has received the design for foam pad 52. Foam pad 52 may be sculpted in separate blocks that mate with stage 54 or as a single block of foam material that mates with stage 54.

Further, while foam pad 52 is shown as having a contoured top surface 61 and flat bottom surface 63, foam pad 52 may be formed such that bottom surface 63 has different levels. That is, bottom surface 63 may have a stepped configuration that creates different thicknesses in foam pad 52. A non-limiting example of such a stepped configuration is shown in FIG. 4A, according to an embodiment of the invention. FIG. 4A shows how the stepped configuration of bottom surface 63 may be created by a plurality of notches 65 in the bottom surface 63 and a plurality of extensions 67 extending from bottom surface 63. However, in various embodiments, the stepped configuration may be created by one or more notches 65, one or more extensions 67, or a combination of one or more notches 65 and one or more extensions 67. The different thicknesses created by notches 65 and extensions 67 may be accounted for in modular putting green 12 by raising or lowering different sections of stage 54, as described in more detail below with respect to FIGS. 5-10.

Figure 4B:
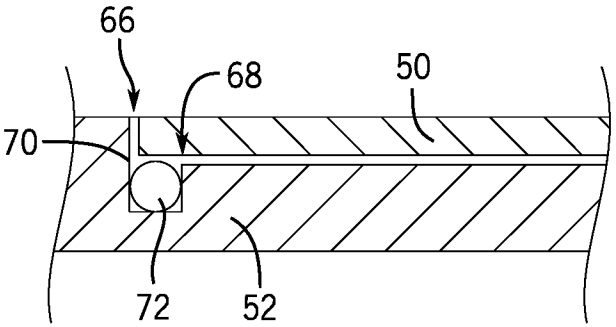
FIG. 4B is a cross-sectional view taken along line 4-4 in FIG. 2 showing how an optional flexible rod attached to the putting green insert may fit within an optional groove in a recessed area of a foam pad under the putting green insert, according to an embodiment of the invention.
Figure 4A:
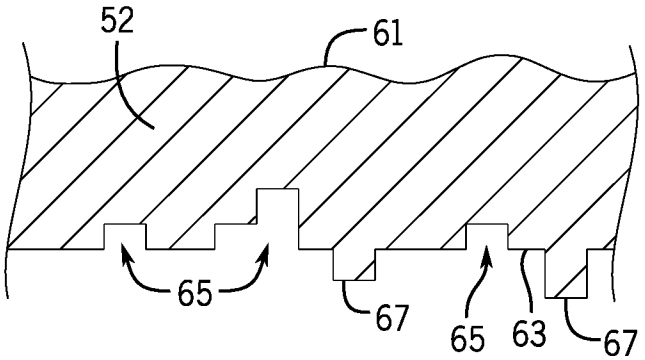
FIG. 4A is a partial side view of a foam pad of the modular putting green shown with a stepped configuration, according to an embodiment of the invention.

Referring now to FIG. 4B, a cross-sectional view of modular putting green 12 taken along line 4-4 in FIG. 3 is shown, in accordance with an embodiment of the invention. FIG. 4B illustrates recessed area 66 of foam pad 52 with a groove 68 at an outer edge 70 thereof and extending partially or completely around recessed area 66. Groove 68 may be included so that an optional flexible rod 72 attached to putting green insert 50 fits therein to help keep putting green insert 50 in position within recessed area 66. As an alternative or in addition to the interaction between groove 68 and flexible rod 72, recessed area 66 may include openings (not shown) therein with hook and loop fasteners (not shown) and interact with hook and loop fasteners (not shown) on putting green insert 50. Such optional openings in recessed area 66 may alternatively include tape or another type of temporary connector.

Figure 5:
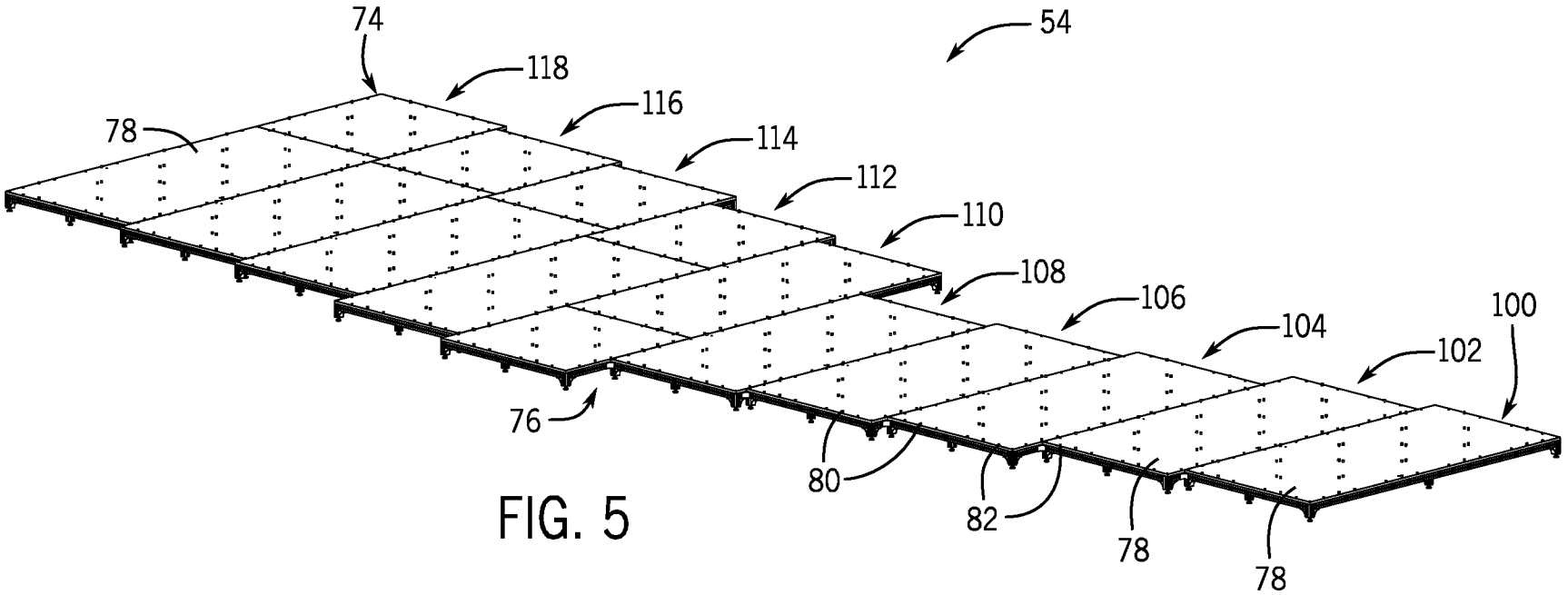
FIG. 5 is a top perspective view of a stage of the modular putting green of FIG. 2, according to an embodiment of the invention.
Figure 6:
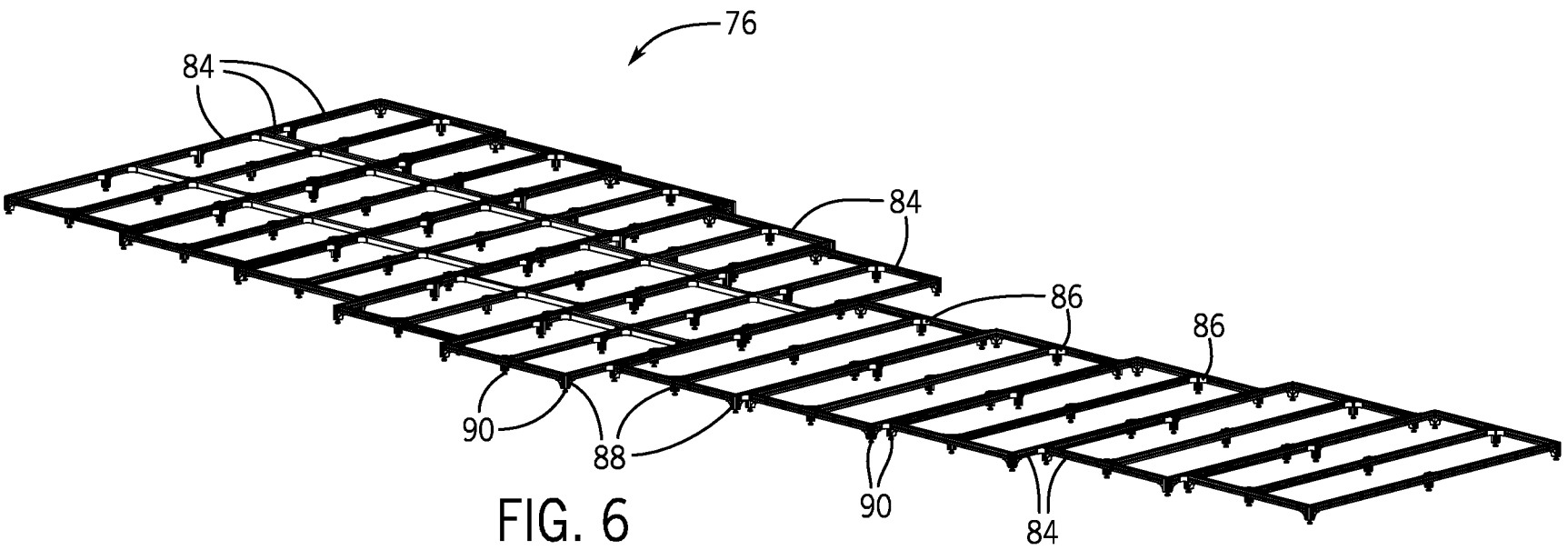
FIG. 6 is a top perspective view of a frame of the modular putting green of FIG. 2, according to an embodiment of the invention.
Figure 7:
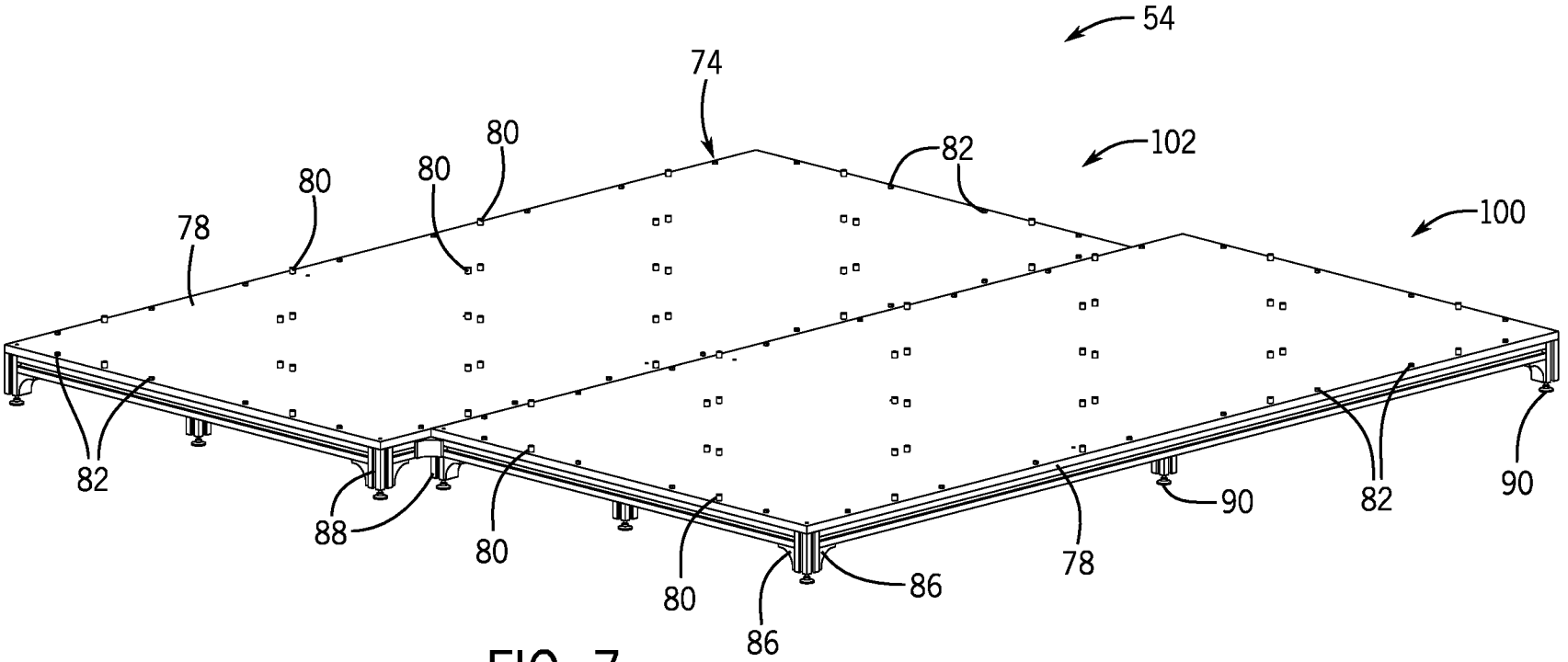
FIG. 7 is a top perspective view of two tables of the stage of FIG. 5, according to an embodiment of the invention.
Figure 8:
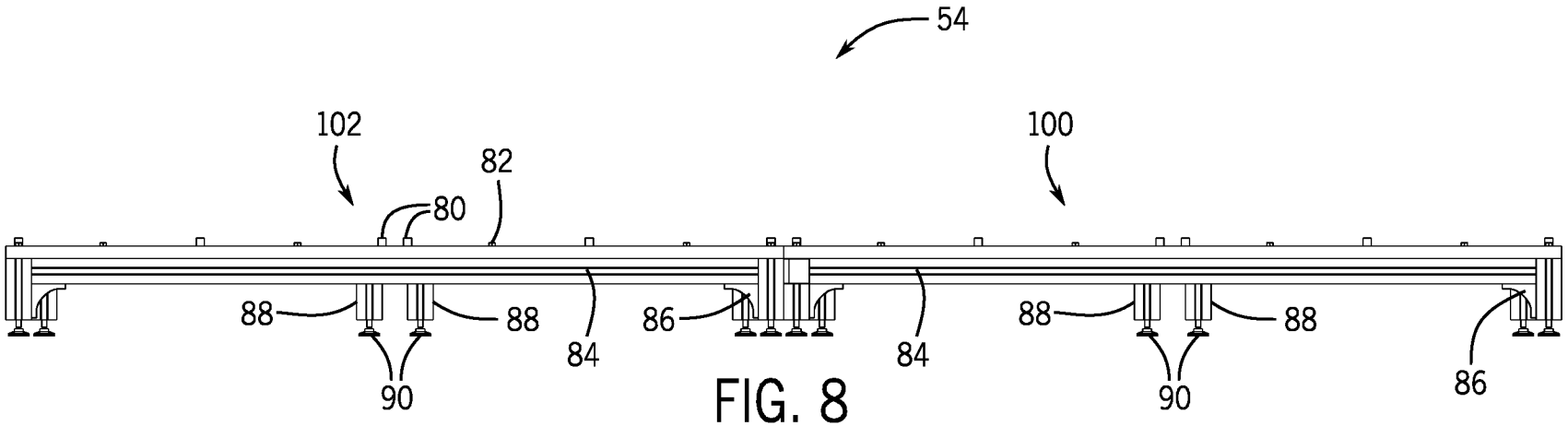
FIG. 8 is a side view of the two tables of FIG. 7, according to an embodiment of the invention.
Figure 9:
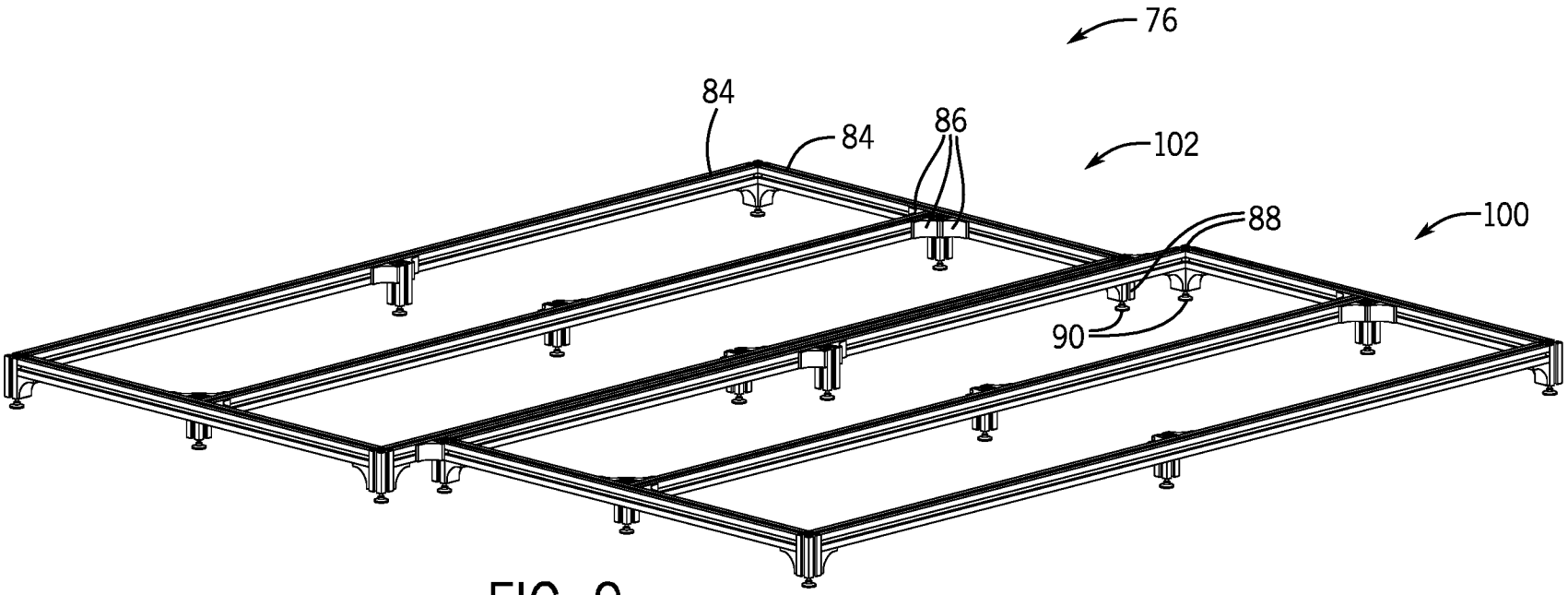
FIG. 9 is a top perspective view of frames for the two tables of FIG. 7, according to an embodiment of the invention.
Figure 10:
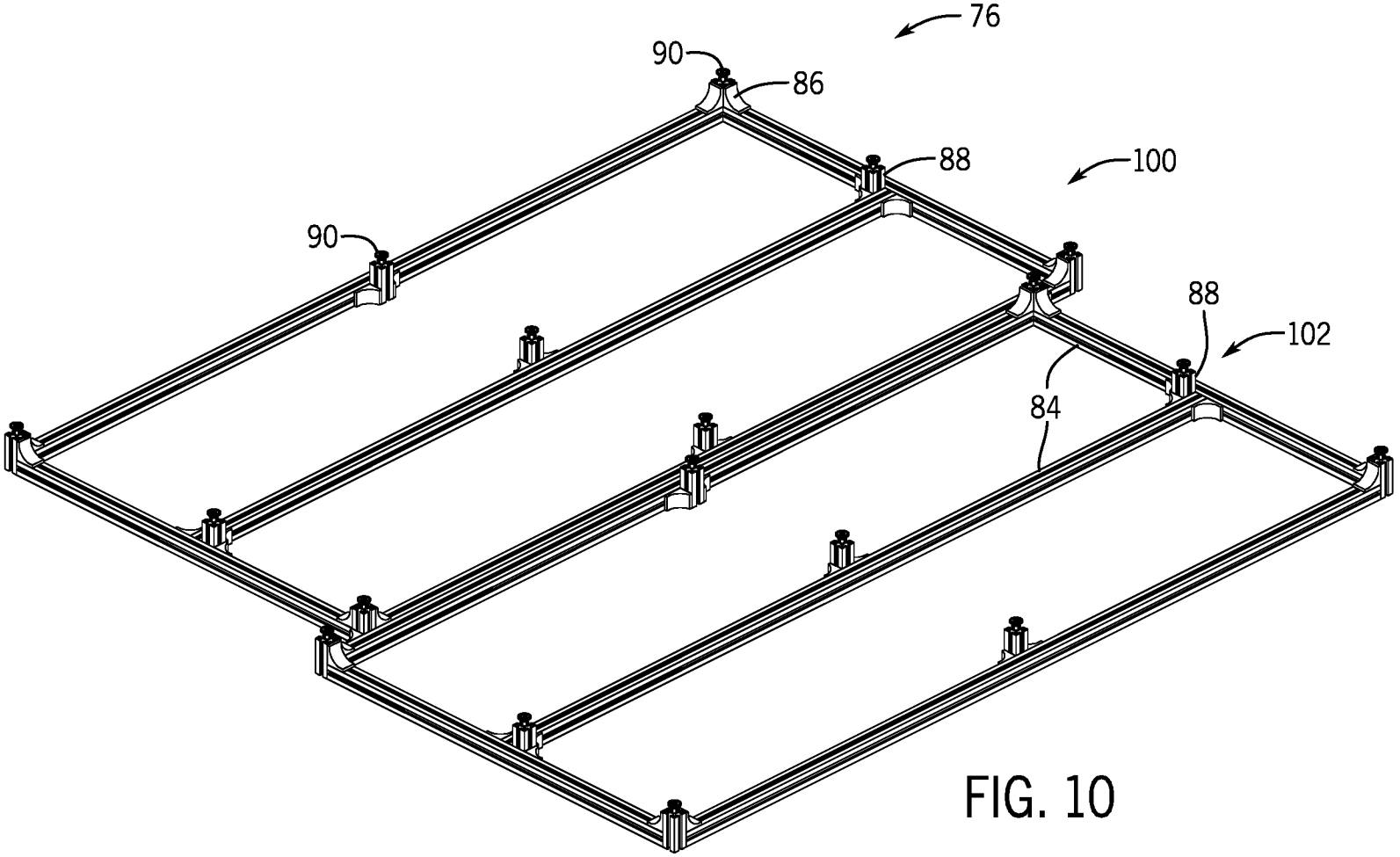
FIG. 10 is a bottom perspective view of the frames of FIG. 8, according to an embodiment of the invention.

Referring now to FIGS. 5 and 6, a top perspective view of stage 54 of modular putting green 12 including a platform 74 and a frame 76 is shown, according to an embodiment of the invention, and a top perspective view of frame 76 of stage 54 is shown, according to an embodiment of the invention. Platform 74 of stage 54 is typically formed from a plurality of platform sections 78, but may be formed of a single platform section 78 if desired. Platform sections 78, in combination with frame 76, may be considered to define a plurality of tables 100-118 extending across stage 54. FIGS. 7 and 8 show a top perspective view and a side view, respectively, of tables 100, 102, according to an embodiment of the invention, and FIGS. 9 and 10 show top and bottom perspective views, respectively, of the components of frame 76 associated with tables 100, 102, according to an embodiment of the invention. FIGS. 7-10 are provided to show the components of stage 54 described below in more detail and may be referenced in addition to FIGS. 5 and 6.

Each platform section 78 of platform 74 is formed of one or more boards with enough strength for at least one golfer to walk thereon. As non-limiting examples, the boards of material may be in the form of a solid wood, an engineered wood, a composite material, or combinations thereof. More specific non-limiting examples of materials for the boards are medium density fibreboard (MDF) and plywood. The boards may vary in length according to the configuration of modular putting green 12.

Platform 74 also includes a plurality of dowel pins 80 and bolt and nut fasteners 82, such as, for example, bolts and corresponding nuts for coupling to frame 76. Dowel pins 80 are arranged in a pattern such that they align with openings (not shown) in foam pad 52. Dowel pins 80 act as locators so that foam pad 52 mates with platform 74 in the proper position. When foam pad 52 has a plurality of different sections, dowel pins 80 enable the sections of foam pad 52 to fit tightly together. Dowel pins 80 may be held in position on platform 74 in various ways. As non-limiting examples, dowel pins 80 may be coupled to platform 74 via an adhesive or may be positioned within dowel openings 81 on platform 74.

Frame 76 of stage 54 includes a plurality of frame rails 84 coupled together via a variety of brackets or connectors 86 and coupled to platform 74 via fasteners 82. Frame 76 also includes a plurality of legs 88 arranged in a pattern engineered to provide the best support for golfers putting on modular putting green 12. Each leg 88 includes a leveling foot 90 that may be accessed through platform 74 via a tool such as, for example, a hex key or Allen wrench. This is most clearly shown in FIG. 13 discussed below. Leveling feet 90 of legs 88 may be adjusted such that stage 54 is level for receiving foam pad 52. Leveling feet 90 may also be adjusted to raise various tables 100-118 to a different height if foam pad 52 has a stepped configuration, as described above with respect to FIG. 4A.

Stage 54 may act as a base for a variety of different configurations of foam pads and putting green inserts. That is, when a consumer wishes to putt on a different green, foam pad 52 may be replaced with another foam pad (not shown) having the appropriate dowel pin locations and a different contour. This other foam pad may be configured to receive putting green insert 50 or another putting green insert with a different shape, material, or other characteristics. The ability to change out the foam pad and putting green insert is what makes this system modular.

Figure 11:
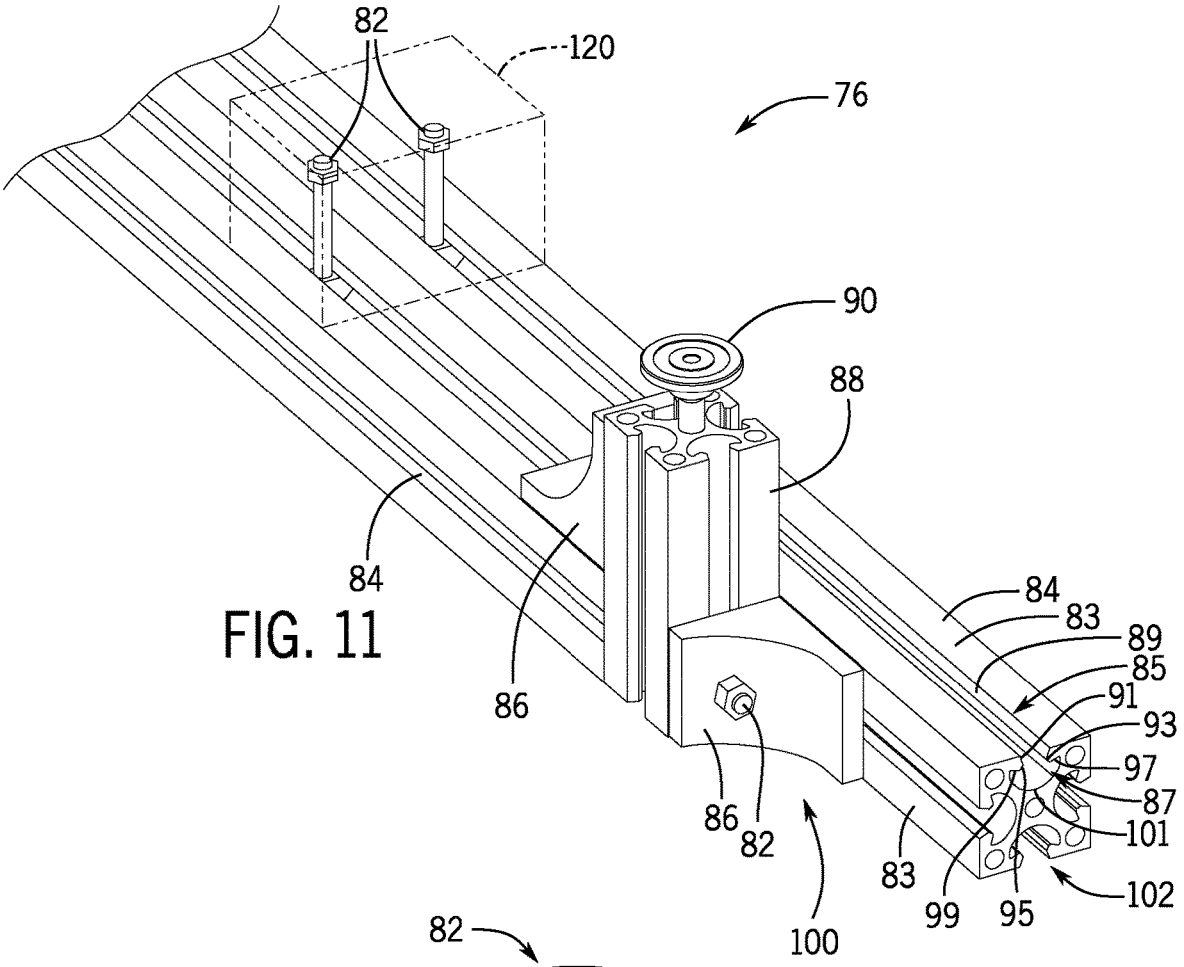
FIG. 11 is a bottom perspective view showing two frame rails of two tables of the frame of FIG. 6 coupled together, according to an embodiment of the invention.
Figure 12:
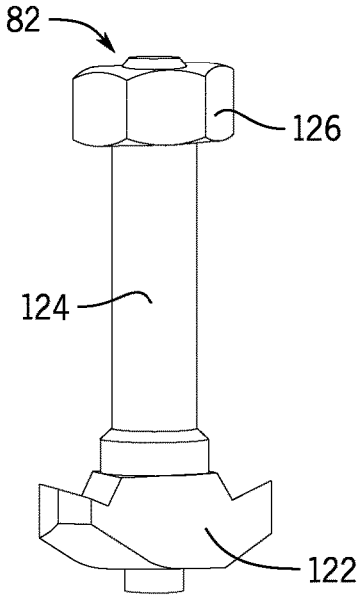
FIG. 12 is a perspective view of a bolt and nut fastener for coupling together the two frame rails of FIG. 11, according to an embodiment of the invention.

Referring now to FIGS. 11-12, perspective views showing how two frame rails 84 of tables 100, 102 of frame 76 may be coupled together and a bolt and nut fastener 82 for coupling frame rails 84 together are shown, according to an embodiment of the invention. As shown in FIG. 11, frame rails 84 may be coupled together via brackets 86 and/or via connectors 120. As shown in FIG. 11, each connector 120 extends, at least in part, across both frame rails 84 such that two bolt and nut fasteners 82 extend through connector 120 and couple connector 120 to frame rails 84, effectively coupling frame rails 84 together. However, the configuration of connector 120 shown in FIG. 11 is a non-limiting configuration, and connector 120 may have a variety of different configurations that accomplish the same purpose.

With respect to frame rails 84 of frame 76, each frame rail 84 has an outer surface that is defined by four identical faces 83. Thus, the description of each face 83 of frame rails 84 is equally applicable to every other face 83 of frame rails 84. Each face 83 is identical in structure and generally flat. Each face 83 includes a slot 85 therein that extends along the entire length thereof and that opens into a longitudinally extending cavity 87. Slot 85 and cavity 87 are substantially symmetrical, whereby description of structures at one side of slot 85 and/or cavity 87 are equally applicable to the corresponding structures on the other side of slot 85 and/or cavity 87, only being mirror images thereof. Slot 85 is defined between first and second sidewalls 89, 91 and, respectively, extending from face 83 at an angle thereto. It is contemplated that the angle falls within the range from 1 degree to 89 degrees, but is preferably from about 30 degrees to about 80 degrees and most preferably about 70 degrees.

Correspondingly, in such a most preferred embodiment, each of the first and second sidewalls 89, 91 defines an angle of about 20 degrees with respect to an imaginary line that extends through the centerline of the slot, whereby the first and second sidewalls 89, 91 define an angle of about 40 degrees between each other. Slot 85 is further defined between first and second outer abutment walls 93, 95, respectively, which diverge from first and second sidewalls 89, 91, respectively. First outer abutment wall 93 angularly intersects first sidewall 89 to define an angle that is greater than 90 degrees therebetween and second outer abutment wall 95 angularly intersects second sidewall 91 to define an angle that is greater than 90 degrees therebetween. The angles defined between first outer abutment wall 93 and first sidewall 89 and between second outer abutment wall 95 and second sidewall 91 are preferably from about 110 degrees to about 160 degrees and are most preferably about 130 degrees.

From respective outermost portions, first and second inner abutment walls 97, 99 define lines that extend angularly down and away from face 83, toward a middle portion of cavity 87. First and second outer abutment walls 93, 95 are at steeper angles or relatively closer to orthogonal with respect to face 83 than are inner abutment walls 97, 99, which are relatively closer to parallel with respect to face 83. In one embodiment, first and second outer abutment walls 93, 95 define angles of about 60 degrees with respect to face 83, whereas inner abutment walls 97, 99 define angles of about 20 degrees or 19 degrees with respect to face 83. A concave terminal wall 101 extends between first and second inner abutment walls 97, 99, and cavity 87 is defined between the inner abutment walls 97, 99 and concave terminal wall 101.

Referring specifically to FIG. 12, fastener 82 includes a head 122, a shaft 124, and a nut 126. Head 122 has a shape that corresponds to the shape of each cavity 87 in frame rails 84. The correspondence between the shape of head 122 of each fastener 82 and the shape of each cavity 87 of each frame rail 84 allows for tightening fasters 82 to frame rails 84 with contact at five points to create a rigid frame. Nut 126 tightens on shaft 124 in order to attach various components, such as, for example, platform 76, brackets 86, and legs 88, to frame rails 84.

Figure 13:
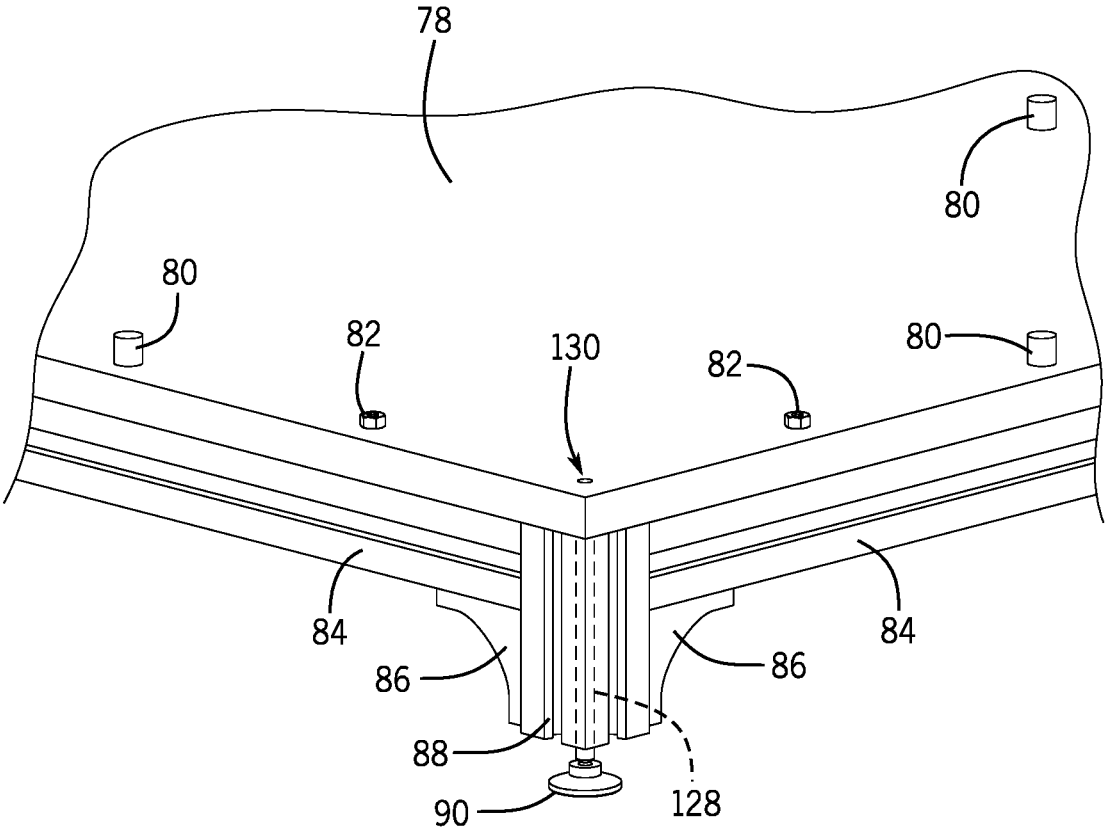
FIG. 13 is a top perspective view of a portion of one of the tables shown in FIG. 7, according to an embodiment of the invention.

FIG. 13 illustrates a portion of table 100 of FIG. 7, according to an embodiment of the invention. The illustrated platform section 78 of platform 74 includes a leveling opening 130 for adjusting leveling foot 90 of leg 88 of frame 76. As explained above, an owner or maintenance worker of modular putting green 12 is able to access a leveling rod 128 of leg 88 to adjust leveling foot 90 via leveling opening 130. This provides a much greater convenience than having to remove platform section 78 to adjust leveling foot 90. Further, while not shown in FIG. 13, in some embodiments, foam pad 52 has a leveling opening corresponding to leveling opening 130 in platform section 78 such that adjusting leveling foot 90 may occur without removing foam pad 52. In addition, putting green insert 50 may also have a leveling opening corresponding to the leveling opening in foam pad 52 and leveling opening 130 in platform 78 such that adjusting leveling foot 90 may occur without removing putting green insert 50. However, at least with respect to putting green insert 50, a leveling opening may not always be possible if it will interfere with a golfer's putt.

Figure 14:
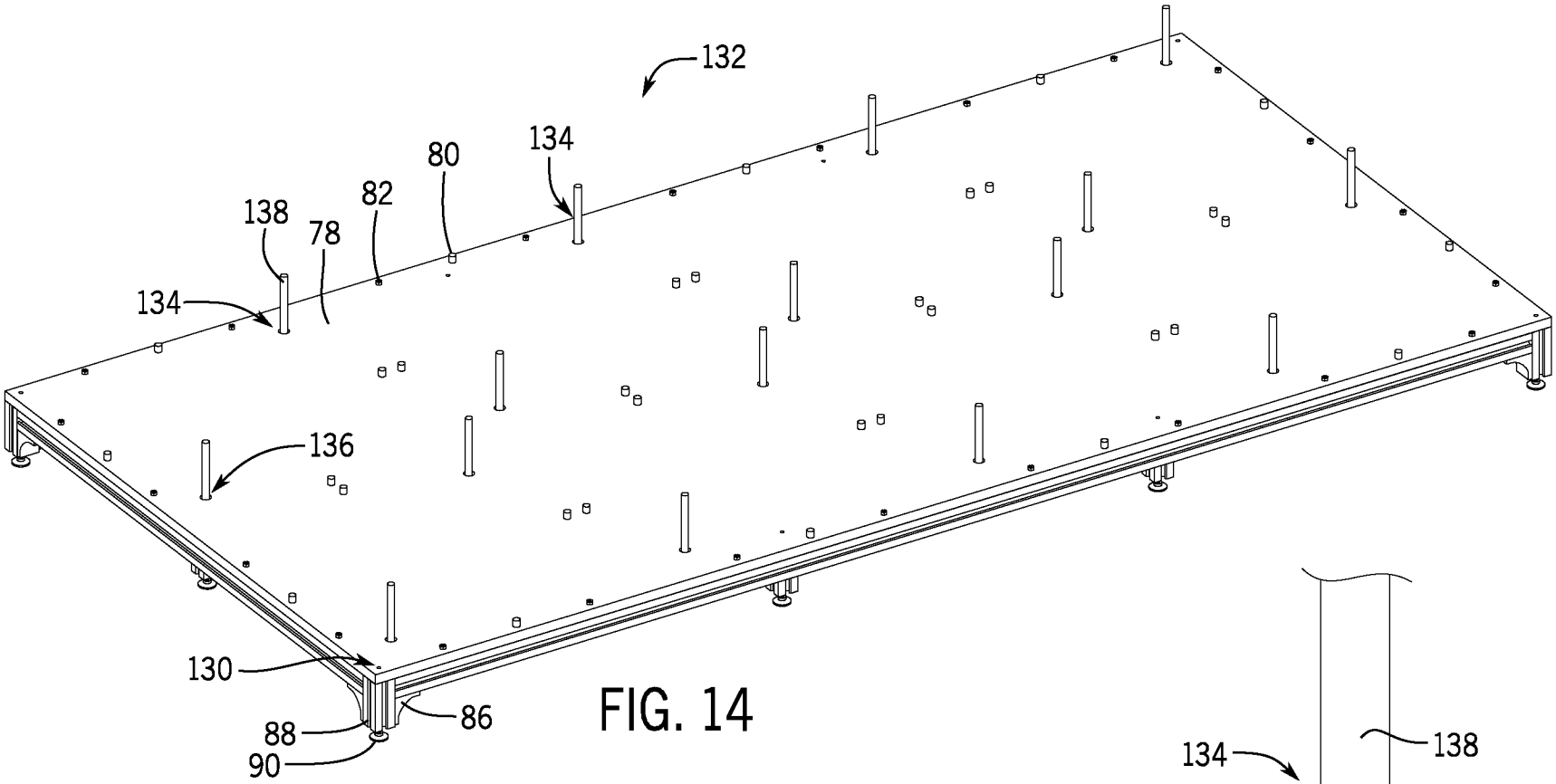
FIG. 14 is a top perspective view a table for use with the stage of FIG. 5, according to another embodiment of the invention.
Figure 15:
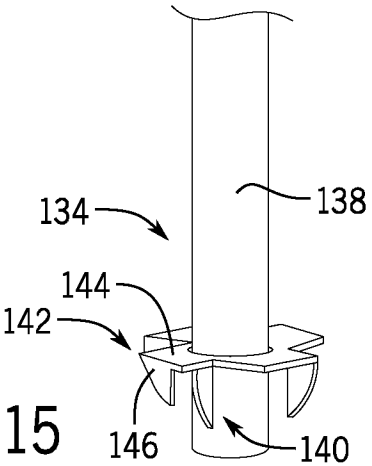
FIG. 15 is a top perspective view of a pole usable with the table of FIG. 14, according to an embodiment of the invention.

Referring now to FIGS. 14 and 15, FIG. 14 illustrates a top perspective view of a table 132 usable with stage 54 of FIG. 5, according to an embodiment of the invention, and FIG. 15 illustrates a top perspective view of a portion of one pole 134 usable with table 132 of FIG. 14, according to an embodiment of the invention. Table 132 is arranged similarly to tables 100-118 shown in FIG. 5 and, thus, like elements are numbered identically to corresponding elements in table 100. That is, table 132 may replace some or all of tables 100-118 in stage 54 of FIG. 5 or may be used in addition to tables 100-188 in stage 54. Table 132 of FIG. 14 differs from tables 100-118 of FIG. 5 in that platform section 78 of table 132 includes poles 134 extending therefrom.

Poles 134 extend from platform section 78 for the same purpose as dowel pins 80. That is, poles 134 act as locators so that foam pad 52 mates with platform 74 in the proper position. When foam pad 52 has a plurality of different sections, poles 134 enable the sections of foam pad 52 to fit tightly together. Poles 134 are especially useful when foam pad 52 includes a plurality of different sections stacked on top of each other. Poles 134 may be held in position on platform 74 in various ways. As illustrated, poles 134 may be coupled to platform 74 within recesses 136. That is, recesses 136 of platform 74 may include a first component of an interlocking fastener (not shown), and poles 134 may include a second component 140 of an interlocking fastener on its shaft 138. As shown, the second component 140 of the interlocking fastener includes a plurality of extensions 142 including a rectangular or square-shaped portion 144 and a generally triangular or spike-shaped portion 146. The first component of the interlocking fastener will have corresponding features to lock each pole 134 in position with second component 140 of the interlocking fastener. However, a variety of different types of interlocking fasteners may be used to lock poles 134 in position on platform 74. As a non-limiting example, recesses 136 on platform 74 may include a receiving nut, and poles 134 may include a threaded end.

While modular putting green 12 has been described with respect to the use of stage 54, stage 54 is not always necessary. That is, foam pad 52 may be placed directly on a surface of a preselected putting area. After selecting the preselected putting area, the geometry of the surface of the preselected putting area is scanned for imperfections, as surfaces are typically not perfectly flat. This scanning is usually performed using a laser scanning system. Also, the scanning typically follows blocking out of the preselected putting area for scanning. That is, the scanner may use tape or other objects to mark out the area for scanning.

Once the scan is complete, foam pad 52 is sculpted to account for the imperfections in the surface of the preselected putting area. Bottom surface 63 of foam pad 52 therefore has a direct surface geometry for placement of foam pad 52 directly onto the desired surface with top surface 61 of foam pad 52 in the predetermined orientation for putting a golf ball. That is, top surface 61 will be in the orientation with which it was designed. However, in some embodiments, foam pad 52 may still have a stage surface geometry such that it is also still usable with stage 54 due to the adjustability of stage 54 or the low number or minor character of imperfections in the surface of the preselected putting area.

Alternatively, only platform 74 may be used. In other words, the surface of platform 74 is scanned and bottom surface 63 of foam pad 52 is sculpted to account for any imperfections in platform 74. The scanning of a surface and placement of foam pad 52 thereon instead of on stage 54 greatly increases cost savings due to not needing at least frame 76. The cost savings are even greater without platform 74.

Beneficially embodiments of the invention thus provide a modular putting green including a putting green insert and a foam pad with a recessed area sized to receive the putting green insert. The modular putting may include an adjustable stage configured to receive foam pad. The foam pad is sculpted with precision according desired characteristics of the consumer, who may also select various characteristics of the putting green insert. The foam pad and putting green insert can easily be replaced, making this system modular and customizable. Further, the modular putting green provides for easy assembly/installation with solid components that may be adjusted to have a precise overall configuration. The foam pad may also be sculpted with a bottom surface to account for imperfections in a surface for direct placement thereon.

Therefore, according to one embodiment of the invention, the modular putting green includes a foam pad configured to mate with the stage, sculpted for putting of a golf ball, and comprising a recessed area. The modular putting green also includes a putting green insert configured to fit at least partially within the recessed area of the foam pad.

According to another embodiment of the invention, a modular putting green includes a foam pad with a top surface sculpted to be positioned at a predetermined orientation for putting a golf ball and having a recessed area. The foam pad additionally includes a bottom surface having a stage surface geometry configured to mate with an adjustable stage such that the top surface is positioned at the predetermined orientation, a direct surface geometry configured to be positioned on and account for imperfections in a surface of a preselected putting area such that the top surface is positioned at the predetermined orientation, or a combination surface geometry configured to either mate with the adjustable stage or to be positioned on and account for imperfections in the surface of the preselected putting area such that the top surface is positioned at the predetermined orientation. Furthermore, the modular putting green includes a putting green insert configured to fit at least partially within the recessed area of the foam pad.

According to yet another embodiment of the invention, a method of manufacturing a modular putting green includes sculpting a foam pad. The foam pad includes a top surface is sculpted to be positioned at a predetermined orientation for putting a golf ball and has a recessed area. The foam pad also includes a bottom surface having a stage surface geometry configured to mate with an adjustable stage such that the top surface is positioned at the predetermined orientation, a direct surface geometry configured to be positioned on and account for imperfections in a surface of a preselected putting area such that the top surface is positioned at the predetermined orientation, or a combination surface geometry configured to either mate with the adjustable stage or to be positioned on and account for imperfections in the surface of the preselected putting area such that the top surface is positioned at the predetermined orientation. The method further includes providing a putting green insert configured to fit at least partially within the recessed area of the foam pad.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A modular putting green comprising:
an adjustable stage comprising:
a platform; and
a frame comprising a plurality of frame rails and legs configured to couple to and support the platform;
a foam pad configured to mate with the stage, sculpted for putting of a golf ball, and comprising a recessed area; and
a putting green insert configured to fit at least partially within the recessed area of the foam pad.

2. The modular putting green of claim 1 wherein:
the platform includes a plurality of dowel pins; and
the foam pad includes a plurality of openings corresponding to the plurality of dowel pins.

3. The modular putting green of claim 1 wherein the foam pad comprises a plurality of foam pad sections.

4. The modular putting green of claim 1 wherein the platform comprises a plurality of platform sections.

5. The modular putting green of claim 1 further comprising a plurality of poles configured to extend from the platform;
wherein the foam pad includes a plurality of openings, each opening of the plurality of openings configured to receive a respective pole of the plurality of poles.

6. The modular putting green of claim 5 wherein:
the platform comprises a plurality recesses; and
each pole of the plurality of poles is mountable within a respective recess of the plurality of recesses of the platform.

7. The modular putting of claim 6 wherein:
each recess of the plurality of recesses of the platform comprises a first end of an interlocking fastener; and
each pole comprises a second end of an interlocking fastener configured to mate with the first end of the interlocking fastener of each recess of the plurality of recesses of the platform to mount the pole on the platform.

8. A modular putting green comprising:
a foam pad comprising:
a top surface sculpted to be positioned at a predetermined orientation for putting a golf ball and comprising a recessed area; and
a bottom surface comprising:
a stage surface geometry configured to mate with an adjustable stage such that the top surface is positioned at the predetermined orientation;
a direct surface geometry configured to be positioned on and account for imperfections in a surface of a preselected putting area such that the top surface is positioned at the predetermined orientation; or
a combination surface geometry configured to either mate with the adjustable stage or to be positioned on and account for imperfections in the surface of the preselected putting area such that the top surface is positioned at the predetermined orientation; and
a putting green insert configured to fit at least partially within the recessed area of the foam pad.

9. The modular putting green of claim 8 further comprising the adjustable stage, the adjustable stage comprising:
a platform comprising a plurality of platform sections, each platform section comprising a top surface configured to support the foam pad and a bottom surface; and
a frame comprising a plurality of frame rails configured to couple to and support the bottom surfaces of the platform sections.

10. The modular putting green of claim 9 further comprising a plurality of dowel pins configured to act as locators for positioning the bottom surface of the foam pad on the platform of the stage.

11. The modular putting green of claim 9 further comprising a plurality of poles configured to act as locators for positioning the bottom surface of the foam pad on the platform of the adjustable stage, each pole of the plurality of poles comprising a height smaller than a thickness of the foam pad between the top and bottom surfaces where the pole is configured to extend through the bottom surface of the foam pad.

12. The modular putting green of claim 8 wherein the foam pad comprises a plurality of foam pad sections.

13. A method of manufacturing a modular putting green, the method comprising:

sculpting a foam pad comprising:

a top surface sculpted to be positioned at a predetermined orientation for putting a golf ball and comprising a recessed area; and a bottom surface comprising:

a stage surface geometry configured to mate with an adjustable stage such that the top surface is positioned at the predetermined orientation;

a direct surface geometry configured to be positioned on and account for imperfections in a surface of a preselected putting area such that the top surface is positioned at the predetermined orientation; or a combination surface geometry configured to either mate with the adjustable stage or to be positioned on and account for imperfections in the surface of the preselected putting area such that the top surface is positioned at the predetermined orientation; and providing a putting green insert configured to fit at least partially within the recessed area of the foam pad.

14. The method of claim 13 wherein sculpting the foam pad comprises machining the foam pad with a computer numerical control (CNC) machine.

15. The method of claim 13 further comprising laser scanning the surface of the preselected putting area prior to sculpting the foam pad.

16. The method of claim 13 further comprising cutting the foam pad into a plurality of foam pad sections.

17. The method of claim 13 wherein sculpting the foam pad comprises sculpting a plurality of foam pad sections configured to collectively comprise the top surface and the bottom surface when positioned correctly on the surface of the preselected putting area.

18. The method of claim 13 further comprising providing the adjustable stage comprising, the adjustable stage comprising:

a platform comprising a plurality of platform sections, each platform section comprising a top surface configured to support the foam pad and a bottom surface; and a frame comprising:

a plurality of frame rails configured to couple to and support the bottom surfaces of the platform sections; and a plurality of legs, each leg comprising a leveling foot 90.

19. The method of claim 18 further comprising:

constructing the adjustable stage by:

coupling the plurality of frame rails together to form the frame; and coupling the plurality of platform sections to the frame to form the platform;

positioning the bottom surface of the foam pad on the platform of the adjustable stage; and inserting the putting green insert within the recessed area of the foam pad.

20. The method of claim 19 further comprising adjusting the leveling foot of at least one leg of the plurality of legs of the frame of the stage.

* * * * *